US011396393B2

(12) United States Patent
Yokota et al.

(10) Patent No.: US 11,396,393 B2
(45) Date of Patent: Jul. 26, 2022

(54) BOX PACKING DEVICE

(71) Applicant: ISHIDA CO., LTD., Kyoto (JP)

(72) Inventors: Yuji Yokota, Ritto (JP); Tatsuya Arimatsu, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 148 days.

(21) Appl. No.: 16/962,225

(22) PCT Filed: Nov. 1, 2018

(86) PCT No.: PCT/JP2018/040738
§ 371 (c)(1),
(2) Date: Jul. 15, 2020

(87) PCT Pub. No.: WO2019/163206
PCT Pub. Date: Aug. 29, 2019

(65) Prior Publication Data

US 2021/0061505 A1 Mar. 4, 2021

(30) Foreign Application Priority Data

Feb. 22, 2018 (JP) ..... JP2018-029351

(51) Int. Cl.
*B65B 5/10* (2006.01)
*B65B 43/54* (2006.01)
(Continued)

(52) U.S. Cl.
CPC ..... *B65B 35/405* (2013.01); *B65B 5/106* (2013.01)

(58) Field of Classification Search
CPC ..... B65B 5/10; B65B 43/54; B65B 43/58
(Continued)

(56) References Cited

U.S. PATENT DOCUMENTS 2,024,503 A * 12/1935 Bickford ..... B65B 5/06 53/392
3,735,561 A * 5/1973 Wood ..... B65B 43/54 53/542

(Continued)

FOREIGN PATENT DOCUMENTS

EP 3248893 A1 11/2017
JP H4-311406 A 11/1992

(Continued)

OTHER PUBLICATIONS

The Search Report from the corresponding International Patent Application No. PCT/JP2018/040738 dated Dec. 18, 2018.

(Continued)

*Primary Examiner* — Douglas A Hess
(74) *Attorney, Agent, or Firm* — Shinjyu Global IP

(57) ABSTRACT

A box packing device includes a push-in mechanism, a retention mechanism, a guide, and a control unit. The push-in mechanism pushes, into a box that is in a state in which an opening thereof faces sideways, the article through the opening. The retention mechanism retains the box that is in a state in which the opening faces sideways and lowers the box after the article have been pushed into the box by the push-in mechanism. The guide opposes the opening and is configured to prevent the article from falling out from the opening of the box that has been lowered by the retention mechanism. The control unit temporarily increases the distance between the box and the guide after the article have been pushed into the box by the push-in mechanism.

8 Claims, 11 Drawing Sheets

(51) Int. Cl.
*B65B 43/58* (2006.01)
*B65B 35/40* (2006.01)

(58) Field of Classification Search
USPC ..... 198/429; 53/245, 255
See application file for complete search history.

(56) References Cited

U.S. PATENT DOCUMENTS

| | | | | |
|---|---|---|---|---|
| 5,732,536 | A * | 3/1998 | Lin | B65B 5/106 53/247 |
| 7,654,062 | B2 * | 2/2010 | Mueller | B65B 43/39 53/251 |
| 7,721,509 | B2 * | 5/2010 | Vissers | B65B 5/06 53/542 |
| 9,908,652 | B2 * | 3/2018 | Yokota | B65B 43/54 |
| 10,549,872 | B2 * | 2/2020 | Yokota | B65B 43/54 |
| 10,787,281 | B2 * | 9/2020 | Iwasa | B65B 5/106 |
| 10,875,674 | B2 * | 12/2020 | Yokota | B65B 5/06 |
| 10,981,683 | B2 * | 4/2021 | Iwasa | B65B 43/59 |

FOREIGN PATENT DOCUMENTS

| | | | |
|---|---|---|---|
| JP | 2004-155428 | A | 6/2004 |
| JP | 2005-145558 | A | 6/2005 |
| JP | 2009-249017 | A | 10/2009 |
| JP | 2011-131901 | A | 7/2011 |
| JP | 2014-061904 | A | 4/2014 |
| JP | 2018-008717 | A | 1/2018 |
| WO | 2017/109941 | A1 | 6/2017 |

OTHER PUBLICATIONS

The Written Opinion of the Search Report from the corresponding International Patent Application No. PCT/JP2018/040738 dated Dec. 18, 2018.

The Search Report from the corresponding European Patent Application No. 18906795.2 dated Feb. 26, 2021.

* cited by examiner

BOX PACKING DEVICE

CROSS-REFERENCE TO RELATED APPLICATIONS

This application is the U.S. National Phase of International Application No. PCT/JP2018/040738, filed Nov. 1, 2018. This application claims priority to Japanese Patent Application No. 2018-029351, filed Feb. 22, 2018. The contents of that application are incorporated by reference herein in their entirety.

TECHNICAL FIELD

The present invention relates to a box packing device for packing articles into boxes.

BACKGROUND ART

Conventionally, a box packing device for packing articles into boxes, such as disclosed in Japanese Patent Application Publication No. 2004-155428 A, has been known. This box packing device pushes articles into a box conveyed thereto in a state in which an opening thereof faces sideways, thereafter lowers the box, and then pushes more articles into the box in the space above the articles that has just been pushed in. That is, this box packing device pushes the articles into the box by repeatedly performing an operation in which it pushes the articles into the box and an operation in which it lowers the box.

BRIEF SUMMARY

However, in a case where the articles are sealed bags, the articles are sometimes compressed by a stopper to ensure that the articles do not stick out of the boxes when the articles are pushed into the boxes. In this case, when lowering the boxes, sometimes the articles freed from the stopper expand and stick out of the boxes a little. Additionally, there is the concern that portions of the articles sticking out of the box will get caught so that the articles end up rotating inside the box. As a result, there is the potential for the articles to not be properly packed and for the articles to end up sustaining damage.

It is an object of the present invention to provide a reliable box packing device that inhibits the occurrence of a problem where, when packing articles into boxes, the articles end up rotating in the boxes.

A box packing device pertaining to the invention includes a push-in mechanism, a retention mechanism, a guide, and a control unit. The push-in mechanism pushes, into a box that is in a state in which an opening thereof faces sideways, an article through the opening. The retention mechanism retains the box that is in a state in which the opening faces sideways and lowers the box after the article have been pushed into the box by the push-in mechanism. The guide opposes the opening and is a member for preventing the article from falling out from the opening of the box that has been lowered by the retention mechanism. The control unit temporarily increases the distance between the box and the guide after the article have been pushed into the box by the push-in mechanism.

The box packing device pertaining to the invention inhibits the articles from getting caught on the guide and rotating in a case where the articles have expanded in the box by temporarily moving the box away from the guide after the box packing device has pushed the articles into the box that is in a state in which the openings face sideways. Consequently, the reliability of the box packing device pertaining to the invention can be improved.

Furthermore, in the box packing device pertaining to the invention, it is preferred that the control unit temporarily tilt the box so that the opening faces upward.

In this case, the box packing device can temporarily move the box away from the guide simply by tilting the box.

Furthermore, it is preferred that the box packing device pertaining to the invention further include a shutter. The shutter is a member that is temporarily inserted inside the box while the push-in mechanism is pushing the article into the box. The push-in mechanism pushes the article resting on top of the shutter into the box.

In this case, the box packing device can smoothly push the articles into the box by using the shutter.

Furthermore, in the box packing device pertaining to the invention, it is preferred that the control unit remove the shutter from the box before temporarily increasing the distance between the box and the guide and, after temporarily increasing the distance between the box and the guide, control the retention mechanism to lower the box, return the distance between the box and the guide to what it was before, and thereafter insert the shutter inside the box.

In this case, the box packing device can appropriately control the distance between the box and the guide by removing and inserting the shutter at appropriate timings.

Furthermore, in the box packing device pertaining to the invention, it is preferred that the control unit, after inserting the shutter inside the box after having returned the distance between the box and the guide to what it was before, raise the box to a position in which the article that have been pushed into the box come into contact with the shutter.

In this case, the box packing device can efficiently pack the articles into the box.

Furthermore, it is preferred that the box packing device pertaining to the invention further include a rotation mechanism. The rotation mechanism rotates the box to switch the box between a state in which the opening faces sideways and a state in which the opening faces upward. The control unit controls the rotation mechanism to temporarily increase the distance between the box and the guide.

In this case, the box packing device can easily control the distance between the box and the guide using the rotation mechanism.

Furthermore, in the box packing device pertaining to the invention, it is preferred that the rotation mechanism have a servo motor for controlling the rotational speed of the box.

In this case, the box packing device can easily control the distance between the box and the guide using the servo motor of the rotation mechanism.

Furthermore, in the box packing device pertaining to the invention, it is preferred that the guide have a shape that recedes upward from the box.

In this case, the box packing device can inhibit the articles from getting caught on the guide and rotating in a case where the articles have expanded in the box.

The box packing device pertaining to the invention inhibits the occurrence of a problem where, when packing articles into boxes, the articles end up rotating in the boxes, so an improvement in reliability can be expected.

DETAILED DESCRIPTION

An embodiment of the invention will be described with reference to the drawings. The embodiment described below is a specific example of the invention and is not intended to limit the technical scope of the invention.

(1) Configuration and Operation of Box Packing Device

Figure 1:
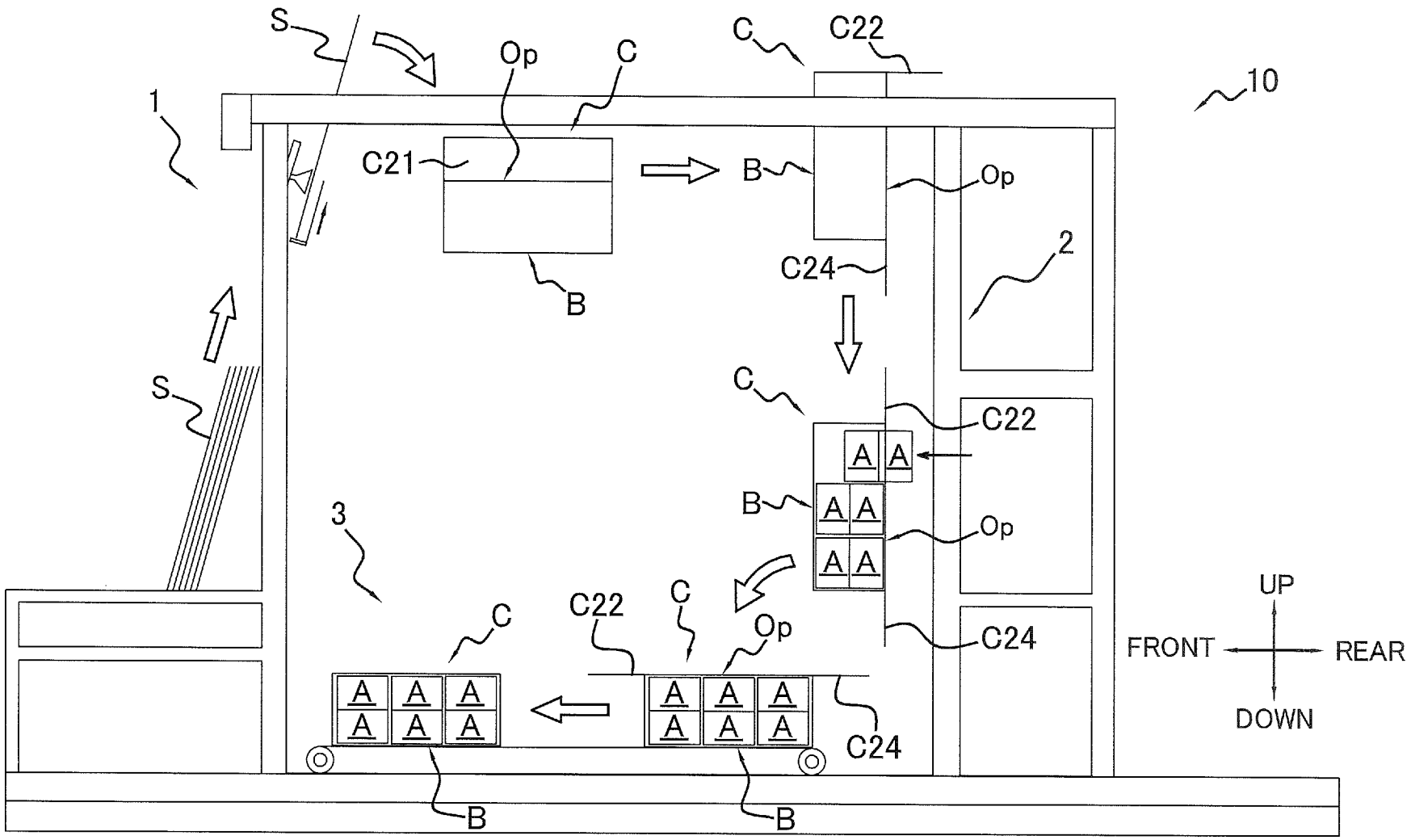
FIG. 1 is a schematic front view of a box packing device 10 pertaining to an embodiment of the invention.

FIG. 1 is a general view of a box packing device 10 pertaining to an embodiment of the invention. The box packing device 10 is installed on a line of a food factory, for example, and is a device for box packing articles A that have been produced on the line of the food factory. The box packing device 10 puts, into cardboard boxes C placed in a location to which the articles A to be packed are fed one after another, a plurality of the articles A through openings Op of the cardboard boxes C to thereby box pack them. The articles A are, for example, bags in which a food such as potato chips is packaged by a packaging material.

The box packing device 10 mainly includes a box making unit 1, a box packing unit 2, and a box closing unit 3. FIG. 1 is a schematic front view of the box packing device 10.

In the following description, terms such as upper, lower, left, right, front (front surface), and rear (back surface) are used to describe directions and positions. These terms, unless otherwise specified, mean up, down, left, right, front, and rear indicated by arrows in the drawings. "Right" is the right side in a case where the box packing device 10 is viewed from the front side, and "left" is the left side in a case where the box packing device 10 is viewed from the front side.

(1-1) Box Making Unit

Figure 2:
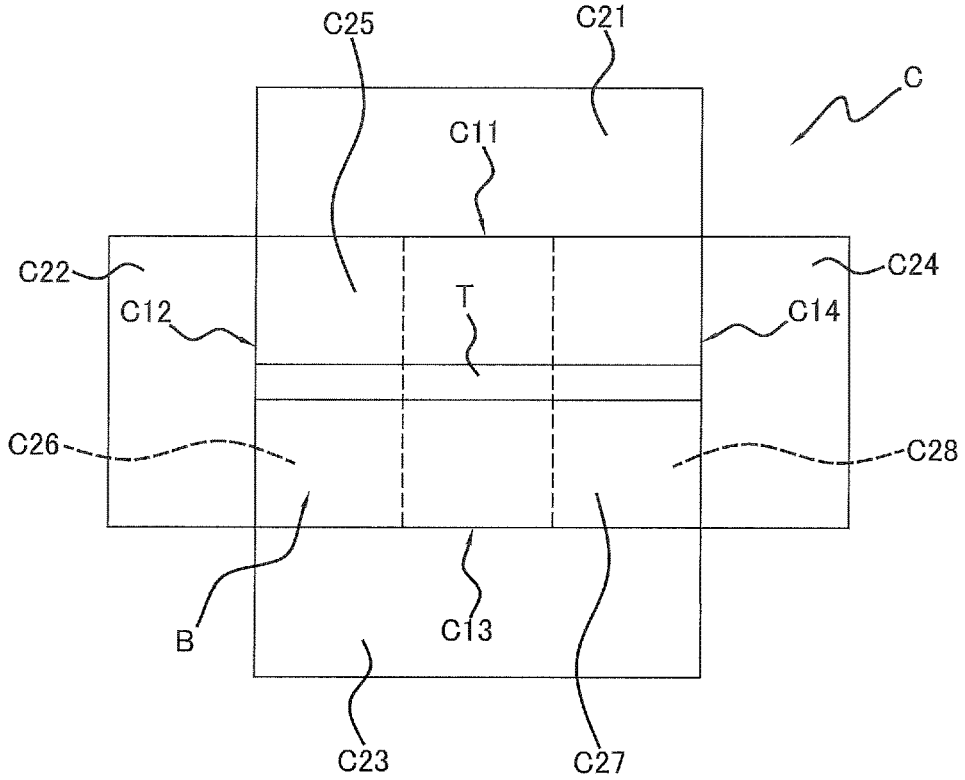
FIG. 2 is a view, seen from a closed bottom lid B side, of a cardboard box C used in the box packing device 10.

The box making unit 1 makes the cardboard boxes C having just one side open by opening cardboard sheets S, which are the cardboard boxes C in a collapsed state, closing bottom lids B of the cardboard boxes C, and sealing the bottom lids B shut with tape T. FIG. 2 is a view of the cardboard box C seen from the closed bottom lid B side. Flaps C21 to C24 on an upper lid side opposite the bottom lid B are opened outward. The opened upper lid side of the cardboard box C corresponds to the opening Op of the cardboard box C.

The cardboard boxes C made by the box making unit 1 are conveyed by a conveyor (not shown in the drawings) to the box packing unit 2. The box making unit 1 feeds one after another the cardboard boxes C it has made to the box packing unit 2.

(1-2) Box Packing Unit

Figure 3A:
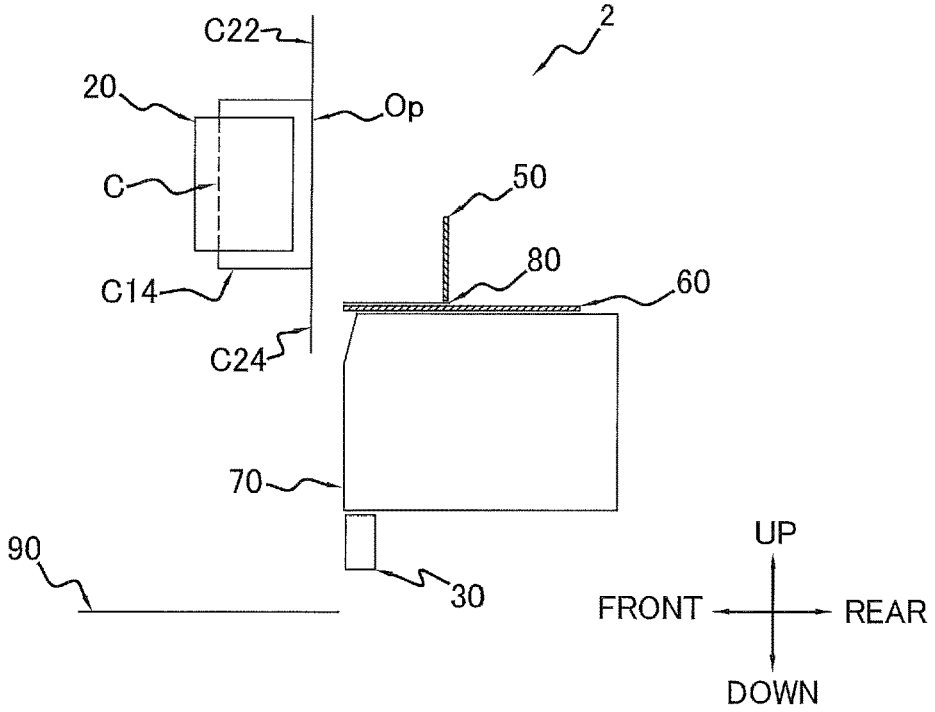
FIG. 3A is a view for describing the operation of a box packing unit 2, and shows a state in which the height position of the cardboard box C has been changed by a drop mechanism 20.

The box packing unit 2 puts a plurality of the articles A into the cardboard boxes C and thereby box packs them. FIG. 3A to FIG. 3H are views for describing the operation of the box packing unit 2. FIG. 3A to FIG. 3H are schematic views, seen from the right side, of the neighborhood of the box packing unit 2 of the box packing device 10 shown in FIG. 1. In FIG. 3A to FIG. 3H, the articles A are put one row at a time six times into the cardboard box C by the box packing unit 2. One row of the articles A put once into the cardboard box C comprises one article A or a plurality of the articles A arranged in the right and left direction. Even when the number of the articles A per row is plural, only the article A positioned on the rightmost side is shown in FIG. 3B to FIG. 3H. As shown in FIG. 3G, in the cardboard box C just after a total of six rows of the articles A have been put into it, two rows of the articles A per layer are box packed in a state in which there are three layers of the articles A stacked on top of each other in the up and down direction. The total number of the articles A put into the cardboard box C, the number of the articles A per row, and the number of rows of the articles A per layer are appropriately decided on the basis of the dimensions of the cardboard box C and the articles A.

The cardboard boxes C that are in a state in which the openings Op face sideways are supplied to the box packing unit 2 by the conveyor of the box making unit 1. Specifically, the cardboard boxes C having the bottom lids B formed on the front surface side of the box packing device 10 and having the openings Op formed on the back surface side of the box packing device 10 are supplied to the box packing unit 2.

As shown in FIG. 2, the cardboard box C used by the box packing device 10 has four side surfaces C11 to C14 that are interconnected in a loop and eight flat panel-like flaps C21 to C28 that extend forward and rearward from the four side surfaces C11 to C14. The flap C21 and the flap C25 extend from the back surface side and the front surface side, respectively, of the side surface C11. The flap C22 and the flap C26 extend from the back surface side and the front surface side, respectively, of the side surface C12. The flap C23 and the flap C27 extend from the back surface side and the front surface side, respectively, of the side surface C13. The flap C24 and the flap C28 extend from the back surface side and the front surface side, respectively, of the side surface C14.

At the point in time when the cardboard box C is supplied to the box packing unit 2, the flaps C25 to C28 on the front surface side of the box packing device 10 have been closed and sealed shut with the tape T by the box making unit 1 to form the bottom lid B. However, at the point in time when the cardboard box C is supplied to the box packing unit 2, the flaps C21 to C24 on the back surface side of the box packing device 10 are open outward. That is, the opening Op of the cardboard box C supplied to the box packing unit 2 faces rearward (the back surface side). The cardboard box C is supplied to the box packing unit 2 in a state in which the side surface C14 faces downward as shown in FIG. 3A to FIG. 3H.

The box packing unit 2 mainly has a drop mechanism 20, a retention mechanism 30, a rotation mechanism 40, a push-in mechanism 50, a shutter 60, a guide 70, an article conveyance mechanism 80, and a box conveyance mechanism 90.

The drop mechanism 20 drops the cardboard boxes C supplied one after another from the box making unit 1. Because of the drop mechanism 20, the cardboard boxes C drop in a state in which the side surface portion C14 faces downward and the opening Op faces rearward.

The retention mechanism 30 retains, in the place where the articles A are packed into the cardboard boxes C, the cardboard boxes C that have been dropped by the drop mechanism 20. Furthermore, the retention mechanism 30 moves the cardboard boxes C that have been packed with the articles A from the place where the articles A were packed to a conveyor belt of the box conveyance mechanism 90. The retention mechanism 30 has a mechanism that rotates the cardboard boxes C about a predetermined axis.

Figure 3B:
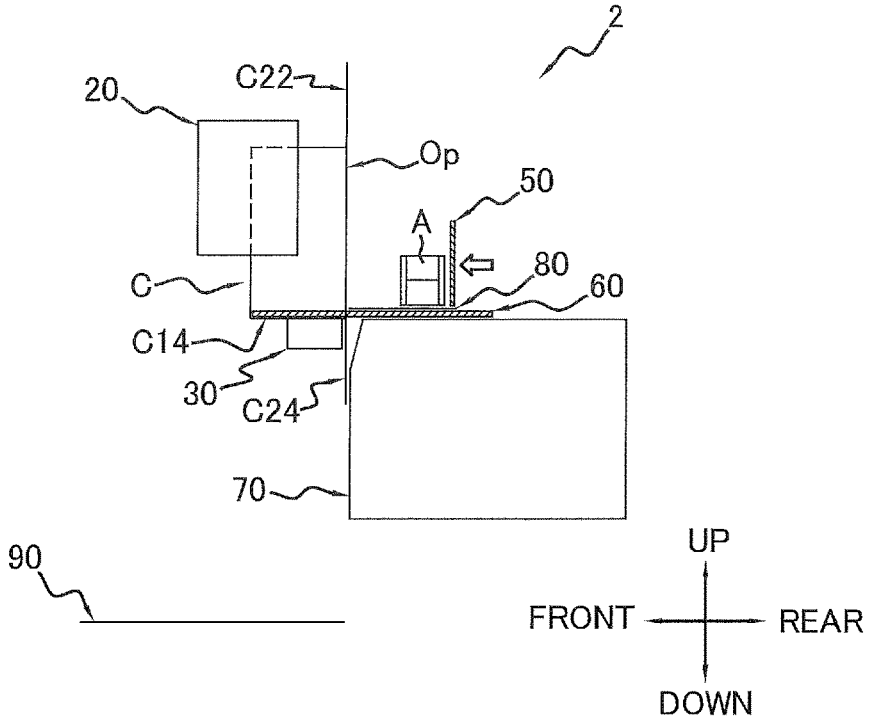
FIG. 3B is a view for describing the operation of the box packing unit 2, and shows a state just before a first layer of articles A is put into the cardboard box C.
Figure 3C:
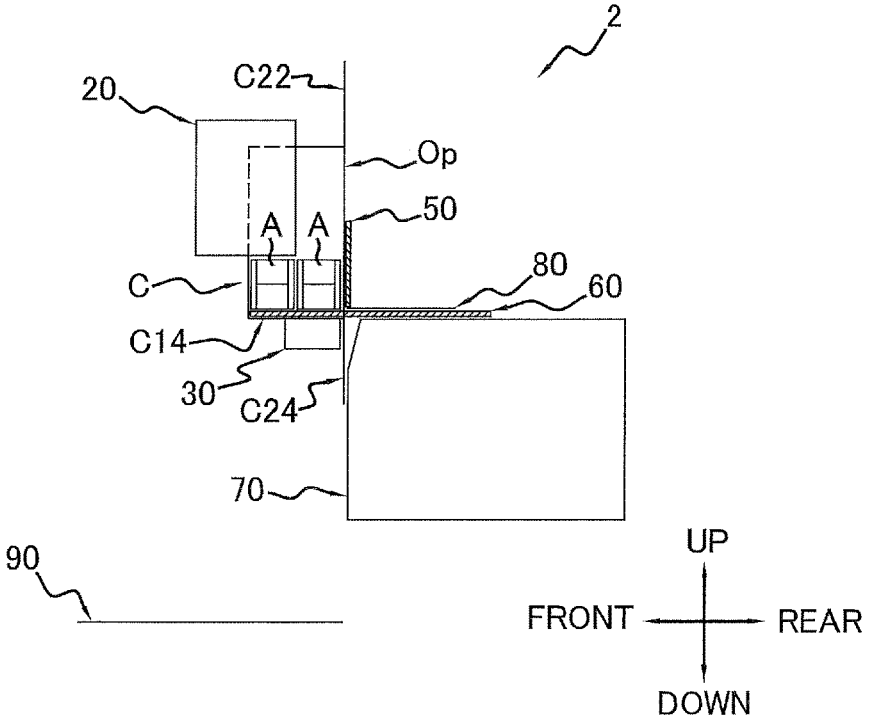
FIG. 3C is a view for describing the operation of the box packing unit 2, and shows a state just after the first layer of the articles A has been put into the cardboard box C.
Figure 3D:
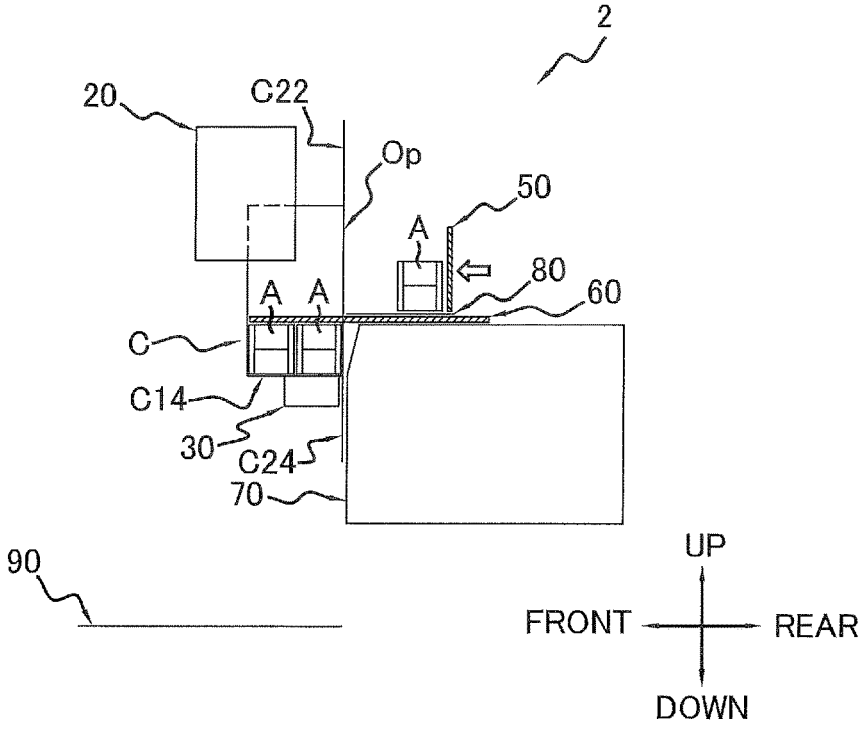
FIG. 3D is a view for describing the operation of the box packing unit 2, and shows a state just before a second layer of the articles A is put into the cardboard box C.
Figure 3E:
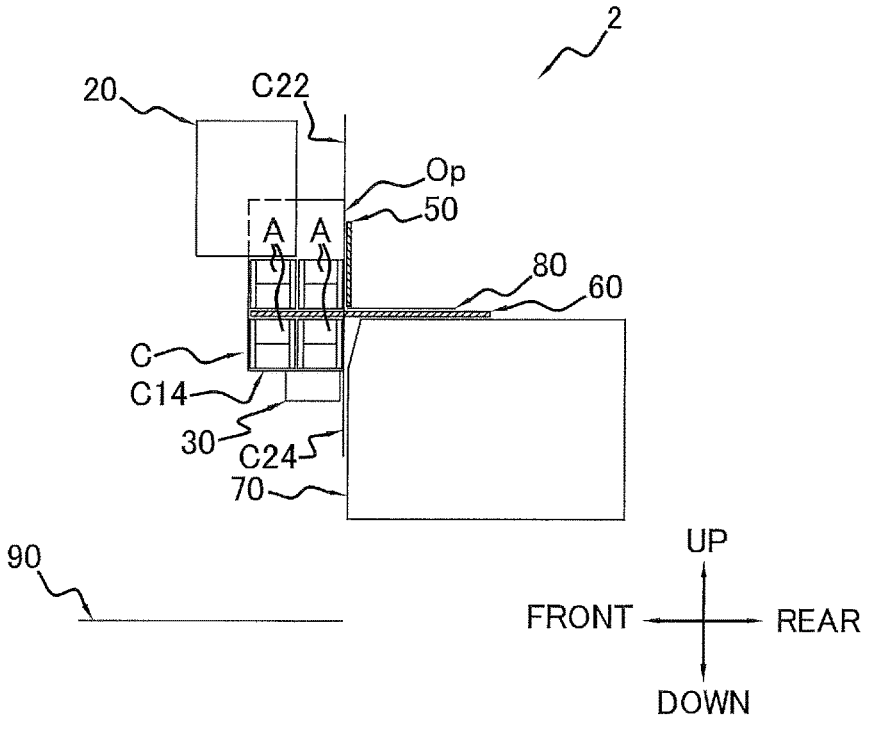
FIG. 3E is a view for describing the operation of the box packing unit 2, and shows a state just after the second layer of the articles A has been put into the cardboard box C.
Figure 3F:
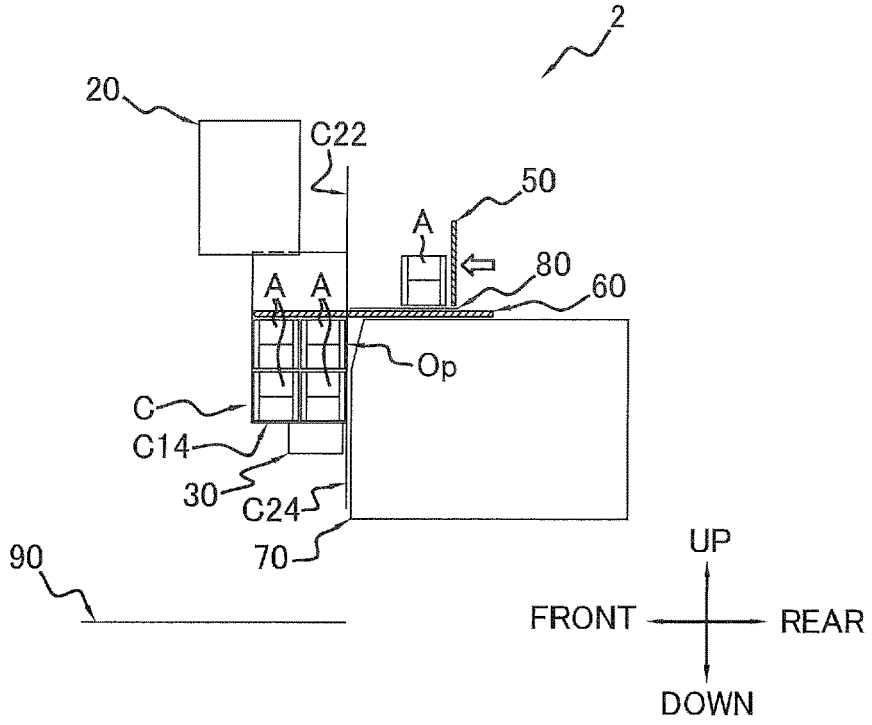
FIG. 3F is a view for describing the operation of the box packing unit 2, and shows a state just before a third layer of the articles A is put into the cardboard box C.
Figure 3G:
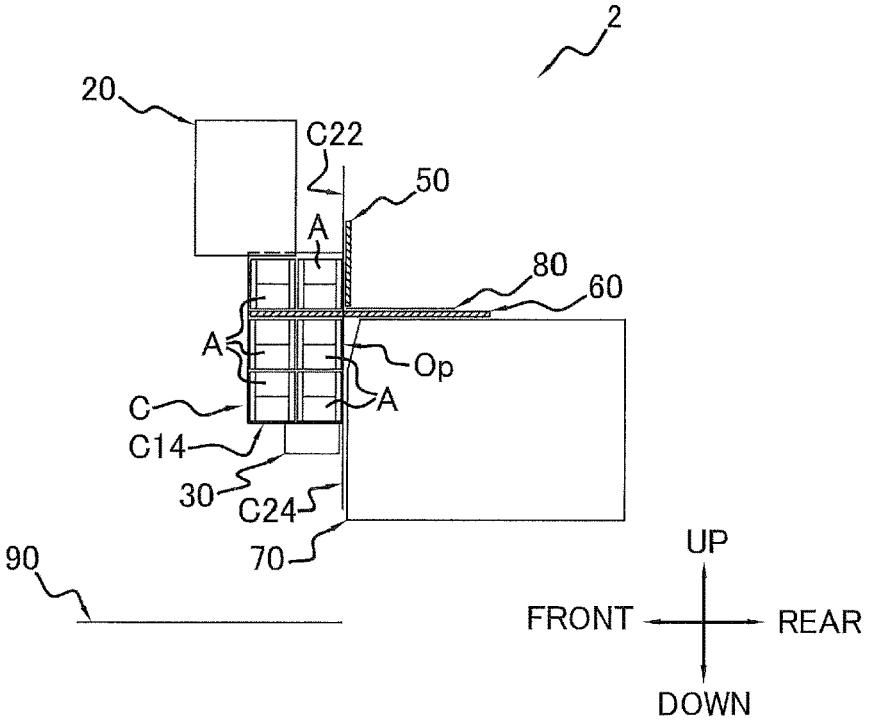
FIG. 3G is a view for describing the operation of the box packing unit 2, and shows a state just after the third layer of the articles A has been put into the cardboard box C.
Figure 3H:
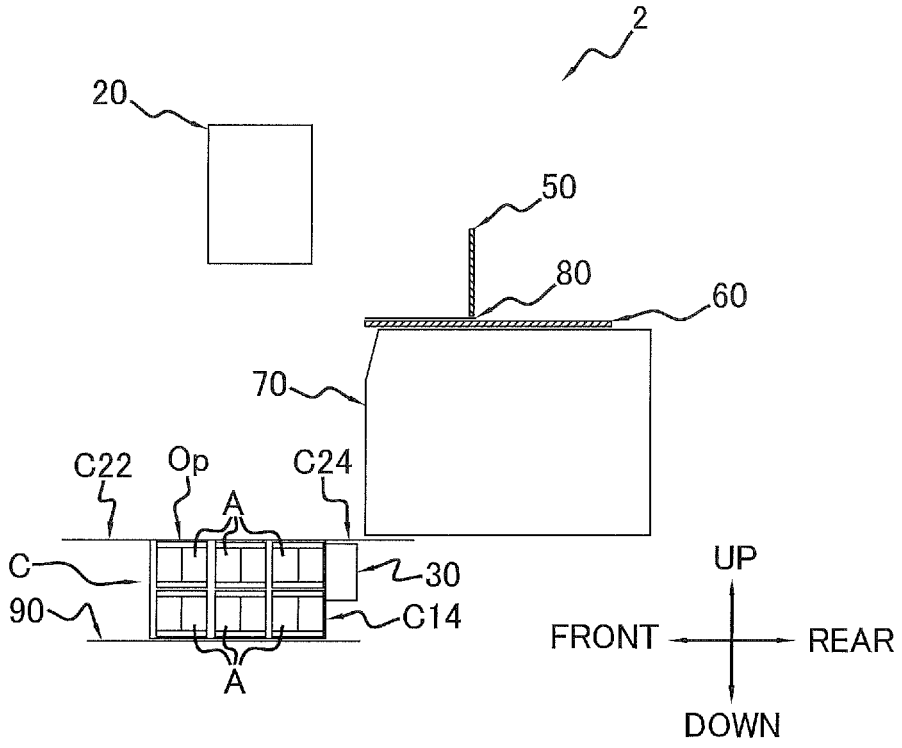
FIG. 3H is a view for describing the operation of the box packing unit 2, and shows a state in which the cardboard box C packed with the articles A is conveyed by a box conveyance mechanism 90.

The rotation mechanism 40 rotates the cardboard boxes C to switch them between a state in which the opening Op faces sideways (rearward) as shown in FIG. 3A to FIG. 3G and a state in which the opening Op faces upward as shown in FIG. 3H. The axis of rotation for rotating the cardboard boxes C lies along the front and rear direction.

The push-in mechanism 50 puts the articles A, which have been conveyed by the article conveyance mechanism 80, through the openings Op of the cardboard boxes C into the cardboard boxes C being retained by the retention mechanism 30. The push-in mechanism 50 puts the articles A into the cardboard boxes C by forwardly pushing off the articles A using a push-off plate.

The shutter 60 is a tabular member for inhibiting the articles A that have already been put into the cardboard boxes C from obstructing the input of the articles A when the articles A are put into the cardboard boxes C. The shutter 60 is inserted into the cardboard boxes C and is removed from the cardboard boxes C as a result of being driven in the front and rear direction by an air cylinder or the like.

The guide 70 prevents the articles A that have already been put into the cardboard boxes C from spilling and falling out of the cardboard boxes C that are in a state in which the opening Op faces sideways. As shown in FIG. 3A to FIG. 3H, the guide 70 has a sloping portion on the upper end portion of its front surface. The sloping portion has a shape that slopes upward and rearward. That is, the sloping portion has a shape that recedes upward away from the cardboard boxes C.

The article conveyance mechanism 80 conveys the articles A before they are put into the cardboard boxes C. The article conveyance mechanism 80 conveys the articles A by means of a conveyor belt at predetermined timings so that the articles A are conveyed to the front of the push-off plate of the push-in mechanism 50.

The box conveyance mechanism 90 conveys, in the horizontal direction by means of a conveyor belt, the cardboard boxes C that have been moved by the retention mechanism 30 and which are in a state in which the opening Op faces upward and supplies them to the box closing unit 3.

(1-3) Box Closing Unit

The box closing unit 3 closes the flaps C21 to C24 of the cardboard boxes C supplied from the box conveyance mechanism 90 of the box packing unit 2 and whose openings Op face upward and seals them shut with tape or the like to form upper lids. The cardboard boxes C whose upper lids have been formed by the box closing unit 3 are conveyed out from the box packing device 10.

(2) Configuration and Operation of Box Packing Unit

Figure 4:
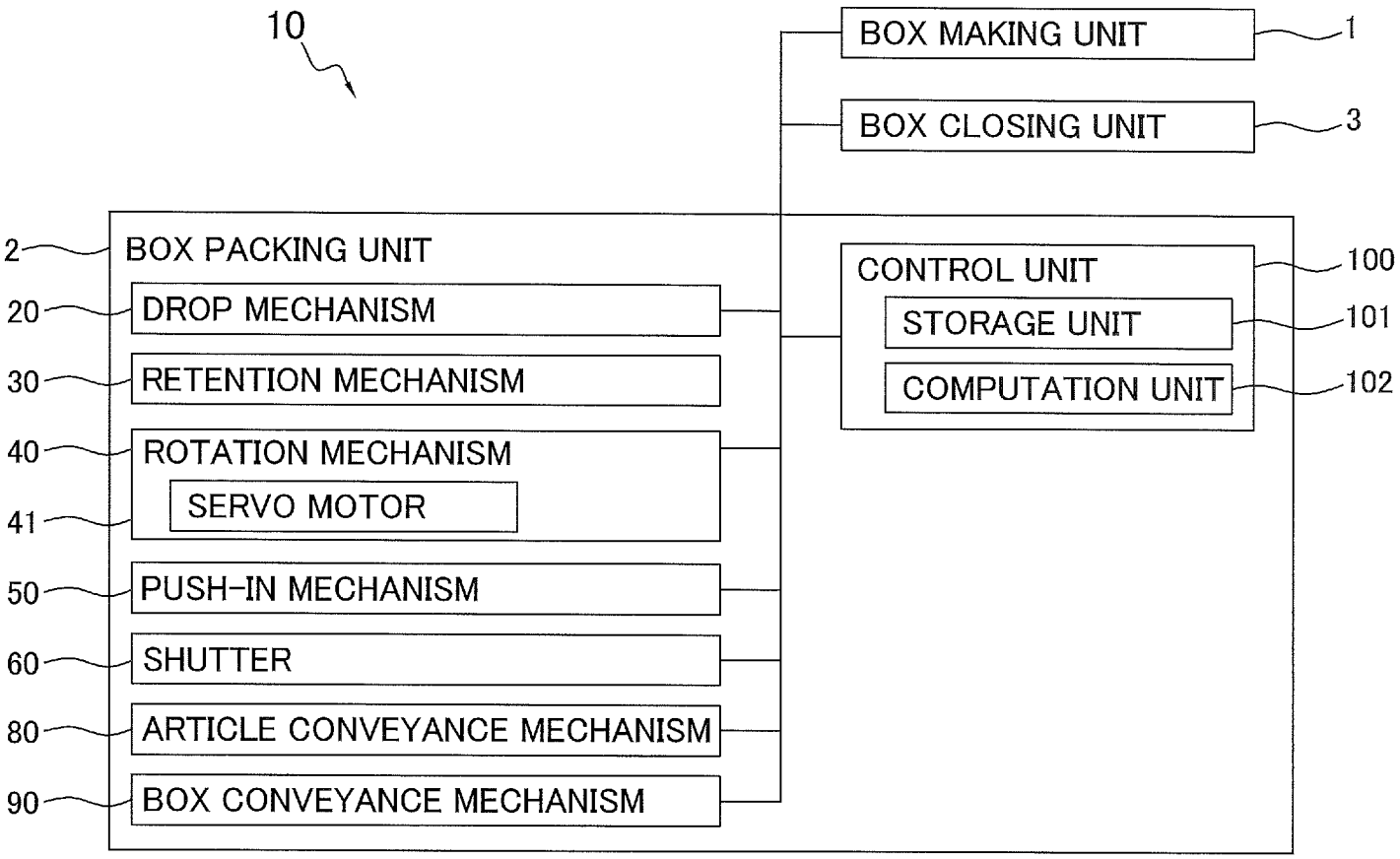
FIG. 4 is a block diagram of the box packing unit 2.

The detailed configuration of the box packing unit 2 will be described. FIG. 4 is a block diagram of the box packing unit 2. The box packing unit 2 has a control unit 100. The control unit 100 is connected to various elements of the box packing unit 2, such as the drop mechanism 20, the retention mechanism 30, the rotation mechanism 40, the push-in mechanism 50, the shutter 60, the article conveyance mechanism 80, and the box conveyance mechanism 90. Furthermore, the control unit 100 is also connected to the box making unit 1 and the box closing unit 3. The control unit 100 mainly controls the various elements of the box packing unit 2 and exchanges various types of information with the various elements of the box packing unit 2. The control unit 100 is, for example, a microcomputer. As shown in FIG. 4, the control unit 100 includes a storage unit 101 and a computation unit 102. The storage unit 101 is mainly configured by a ROM, a RAM, and a hard disk drive (HDD). The computation 102 is mainly configured by a CPU.

The control unit 100 controls the rotation mechanism 40 to adjust the posture of the cardboard boxes C. Specifically, the control unit 100 controls the angle of the cardboard boxes C so that the posture of the cardboard boxes C becomes an arbitrary posture between a state in which the opening Op faces sideways and a state in which the opening Op faces upward. The rotation mechanism 40 has a servo motor 41. The control unit 100 controls the servo motor 41 to control the rotational speed of the cardboard boxes C when changing the angle of the cardboard boxes C.

The detailed operation of the box packing unit 2 will be described with reference to FIG. 3A to FIG. 3H. First, as shown in FIG. 3A, the cardboard box C that is in a state in which the opening OP faces sideways is dropped by the drop mechanism 20 so that the height position of the cardboard box C is changed. Specifically, the cardboard box C drops to a predetermined height position while the right-side flap C21 and the left-side flap C23 are supported.

Next, as shown in FIG. 3B, the retention mechanism 30 moves to a position in which it comes into contact with the side surface C14 of the cardboard box C. At this time, the opening Op of the cardboard box C faces sideways, and the side surface C14 of the cardboard box C is positioned on the lower side. The retention mechanism 30 can move the cardboard box C in the up and down direction in a state in which it sucks hold of the side surface C14 of the cardboard box C and retains the cardboard box C. Furthermore, as described later, the retention mechanism 30 can rotate the cardboard box C about a predetermined axis in a state in which it retains the cardboard box C. The control unit 100 controls the retention mechanism 30 to move the cardboard box C in the up and down direction and, as shown in FIG. 3B, move the cardboard box C to a position in which a first layer of two rows of the articles A can be pushed one row at a time into the cardboard box C. Furthermore, the control unit 100 controls the shutter 60 to insert the shutter 60 through the opening Op of the cardboard box C and push in the shutter 60 as far as the neighborhood of the bottom lid B of the cardboard box C. Furthermore, the control unit 100 controls the push-in mechanism 50 to move the push-off plate of the push-in mechanism 50 rearward. Additionally, the articles A to be pushed into the cardboard box C are conveyed one row's worth at a time by the article conveyance mechanism 80 to the rear of the opening Op of the cardboard box C and the front of the push-off plate of the push-in mechanism 50.

Next, as indicated by the arrow in FIG. 3B, the control unit 100 controls the push-in mechanism 50 to move the push-off plate of the push-in mechanism 50 forward and forwardly push off a first row of the articles A conveyed by the article conveyance mechanism 80. Thereafter, the control unit 100 repeats the same control to forwardly push off a second row of the articles A conveyed by the article conveyance mechanism 80. Because of this, two rows' worth of the articles A are pushed into the cardboard box C while being placed on the shutter 60 as shown in FIG. 3C. As a result, a first layer of two rows of the articles A is put into the cardboard box C.

Next, the retention mechanism 30 moves the cardboard box C downward. Specifically, the control unit 100 controls the retention mechanism 30 to move the cardboard box C downward and thereby move the cardboard box C to a position in which a second layer of two rows of the articles A can be pushed one row at a time into the cardboard box C as shown in FIG. 3D. Before the retention mechanism 30 moves the cardboard box C downward, the control unit 100 controls the shutter 60 to remove the shutter 60 from the cardboard box C. After the retention mechanism 30 has moved the cardboard box C downward, the control unit 100 controls the shutter 60 to reinsert the shutter 60 through the opening Op of the cardboard box C. Furthermore, the control unit 100 controls the push-in mechanism 50 to move the push-off plate of the push-in mechanism 50 rearward. Additionally, more articles A to be pushed into the cardboard box C are conveyed one row at a time by the article conveyance mechanism 80 to the rear of the opening Op of the cardboard box C and the front of the push-off plate of the push-in mechanism 50. Details of the operation of moving the cardboard box C downward will be described later.

Next, as indicated by the arrow in FIG. 3D, the control unit 100 controls the push-in mechanism 50 to move the push-off plate of the push-in mechanism 50 forward and forwardly push off a first row's worth of the articles A conveyed by the article conveyance mechanism 80. Thereafter, the control unit 100 repeats the same control to forwardly push off a second row's worth of the articles A conveyed by the article conveyance mechanism 80. Because of this, two rows' worth of the articles A are pushed into the cardboard box C while being placed on the shutter 60 as shown in FIG. 3E. As a result, a second layer of two rows of the articles A is put into the cardboard box C. The second layer of two rows of the articles A is positioned above the first layer of two rows of the articles A.

Next, the retention mechanism 30 moves the cardboard box C downward. Specifically, the control unit 100 controls the retention mechanism 30 to move the cardboard box C downward and thereby move the cardboard box C to a position in which a third layer of two rows of the articles A can be pushed one row at a time into the cardboard box C as shown in FIG. 3F. Before the retention mechanism 30 moves the cardboard box C downward, the control unit 100 controls the shutter 60 to remove the shutter 60 from the cardboard box C. After the retention mechanism 30 has moved the cardboard box C downward, the control unit 100 controls the shutter 60 to reinsert the shutter 60 through the opening Op of the cardboard box C. Furthermore, the control unit 100 controls the push-in mechanism 50 to move the push-off plate of the push-in mechanism 50 rearward. Additionally, more articles A to be pushed into the cardboard box C are conveyed one row at a time by the article conveyance mechanism 80 to the rear of the opening Op of the cardboard box C and the front of the push-off plate of the push-in mechanism 50.

Next, as indicated by the arrow in FIG. 3F, the control unit 100 controls the push-in mechanism 50 to move the push-off plate of the push-in mechanism 50 forward and forwardly push off a first row of the articles A conveyed by the article conveyance mechanism 80. Thereafter, the control unit 100 repeats the same control to forwardly push off a second row of the articles A conveyed by the article conveyance mechanism 80. Because of this, two rows' worth of the articles A are pushed into the cardboard box C while being placed on the shutter 60 as shown in FIG. 3G. As a result, a third layer of two rows of the articles A are put into the cardboard box C. The third layer of two rows of the articles A is positioned above the second layer of two rows of the articles A. At this time, a total of six rows of the articles A have been packed in three layers into the cardboard box C.

Next, the control unit 100 controls the shutter 60 to remove the shutter 60 from the opening Op of the cardboard box C. Next, the control unit 100 controls the retention mechanism 30 to move the cardboard box C downward and at the same time controls the rotation mechanism 40 to rotate the cardboard box C 90°. Because of this, the cardboard box C transitions from a state in which the opening Op faces sideways to a state in which the opening Op faces upward. Next, the control unit 100 controls the retention mechanism 30 to move the cardboard box C and place the cardboard box C onto the conveyor belt of the box conveyance mechanism 90 as shown in FIG. 3H. Next, the control unit 100 cancels the retention of the cardboard box C by the retention mechanism 30. Next, the cardboard box C is conveyed by the box conveyance mechanism 90. Because of this, the cardboard box C holding six rows of the articles A is conveyed from the box packing unit 2 to the box closing unit 3.

In this way, the box packing unit 2 puts the articles A in multiple layers into the cardboard box C. Specifically, the box packing unit 2 pushes the articles A one row at a time six times into the cardboard box C while moving the cardboard box C in the up and down direction. Furthermore, the box packing unit 2 pushes the articles A two times per layer into the cardboard box C. For that reason, the operation of moving the cardboard box C in the up and down direction to change the position (layer) in which the articles A are put into the cardboard box C is performed the same number of times as the number of layers (three layers) of the articles A packed into the cardboard box C.

Next, details of the operation by which the retention mechanism 30 moves the cardboard box C downward in order for the next layer of the articles A to be pushed into the cardboard box C after the first layer or the second layer of the articles A has been pushed into the cardboard box C will be described. FIG. 5A to FIG. 5G are views for describing the operation by which the retention mechanism 30 moves downward the cardboard box C holding the first layer of two rows of the articles A. FIG. 5A to FIG. 5G show a state between those of FIG. 3C and FIG. 3D.

Figure 5A:
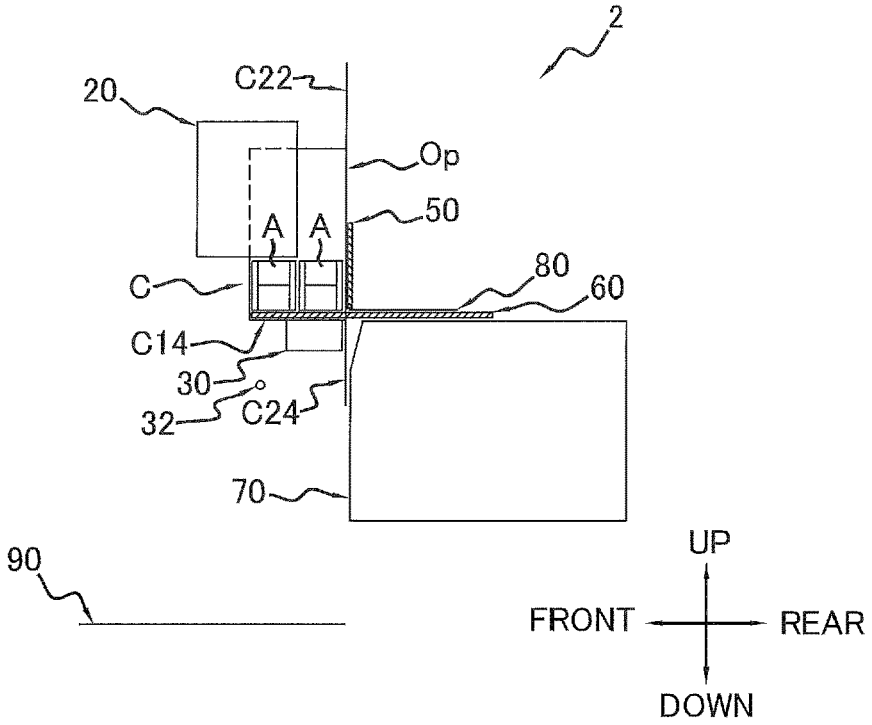
FIG. 5A is a diagram for describing the operation of the box packing unit 2, and shows a state just after the first layer of the articles A has been put into the cardboard box C.
Figure 5B:
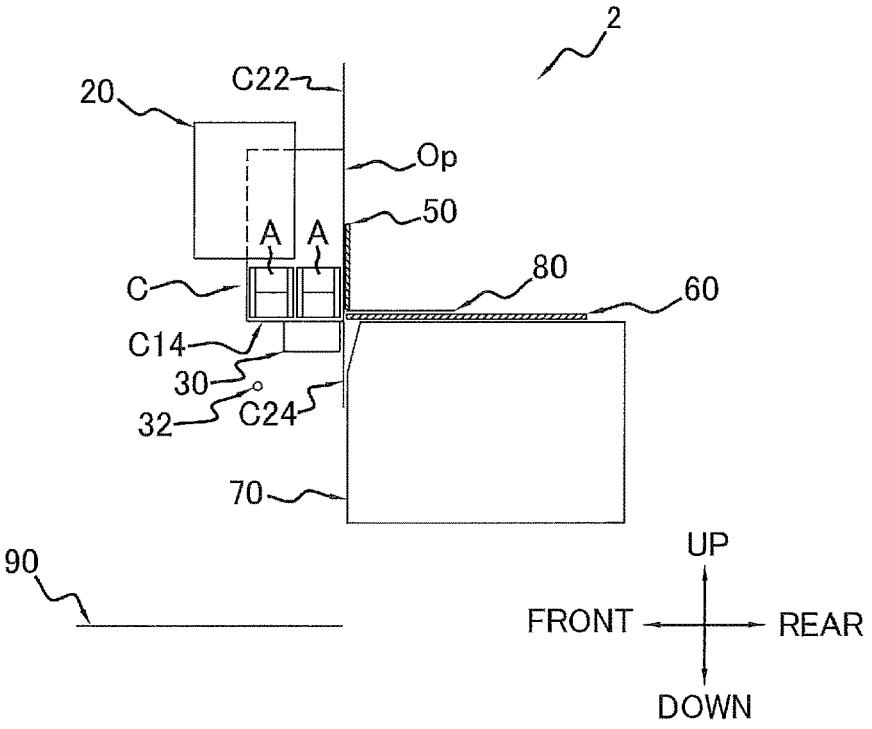
FIG. 5B is a view for describing the operation of the box packing unit 2, and shows a state in which a shutter has been removed from the cardboard box C.

FIG. 5A shows the same state as FIG. 3C, and shows a state just after the first layer of two rows of the articles A has been put into the cardboard box C. Next, as shown in FIG. 5B, the shutter 60 is temporarily removed from the cardboard box C in order to move the cardboard box C downward. At this time, the control unit 100 controls the shutter 60 to move the shutter 60 rearward and remove the shutter 60 from the opening Op of the cardboard box C.

Figure 5C:
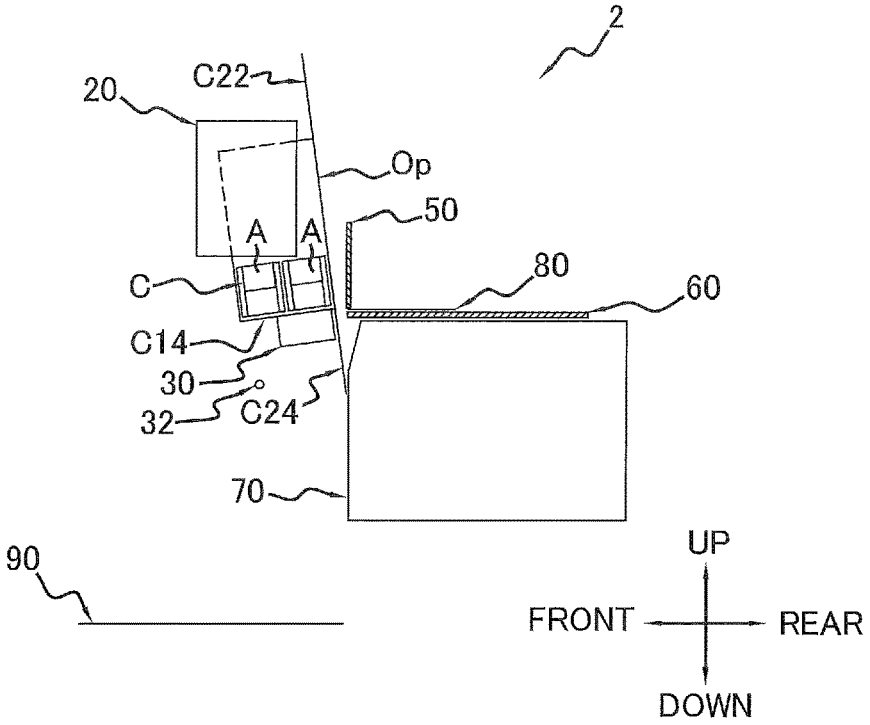
FIG. 5C is a view for describing the operation of the box packing unit 2, and shows a state in which the cardboard box C has been tilted.

Next, as shown in FIG. 5C, the cardboard box C rotates a predetermined angle to a tilted state. At this time, the control unit 100 controls the rotation mechanism 40 and the servo motor 41 to rotate the cardboard box C the predetermined angle so that the opening Op of the cardboard box C faces upward. In FIG. 5A to FIG. 5G, the cardboard box C rotates about an axis of rotation 32. As shown in FIG. 5A to FIG. 5G, the cardboard box C rotates counter-clockwise in a case where it is viewed from the right side. The angle of rotation of the cardboard box C is, for example, 5° to 30°. The upper flap C22 of the cardboard box C in the rotated and tilted state is positioned more forward than the lower flap C24. The purpose of tilting the cardboard box C in this way is to temporarily increase the distance between the cardboard box C and the guide 70. Because of this, the articles A already held in the cardboard box C move away from the front surface of the guide 70, so the articles A in the cardboard box C are inhibited from contacting the guide 70, as described later.

Figure 5D:
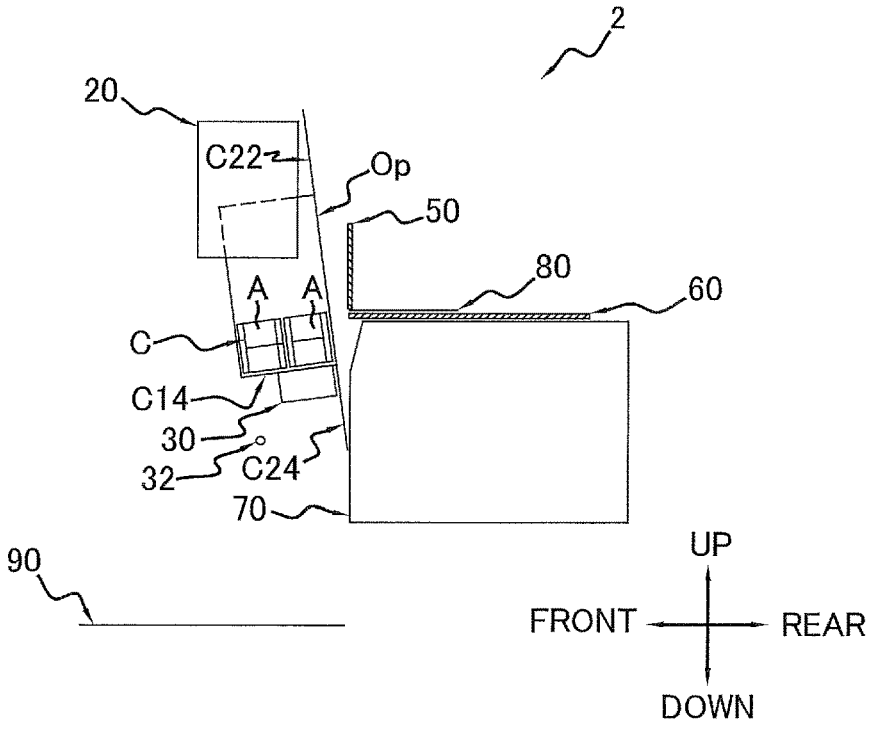
FIG. 5D is a view for describing the operation of the box packing unit 2, and shows a state in which the cardboard box C in the tilted state has been moved downward.

Next, as shown in FIG. 5D, the cardboard box C moves downward. At this time, the control unit 100 controls the retention mechanism 30 to move the cardboard box C in its tilted state downward along the up and down direction. How much the cardboard box C is moved in the up and down direction is the same as, or substantially the same as, the up and down direction dimension of the articles A held in the cardboard box C.

Figure 5E:
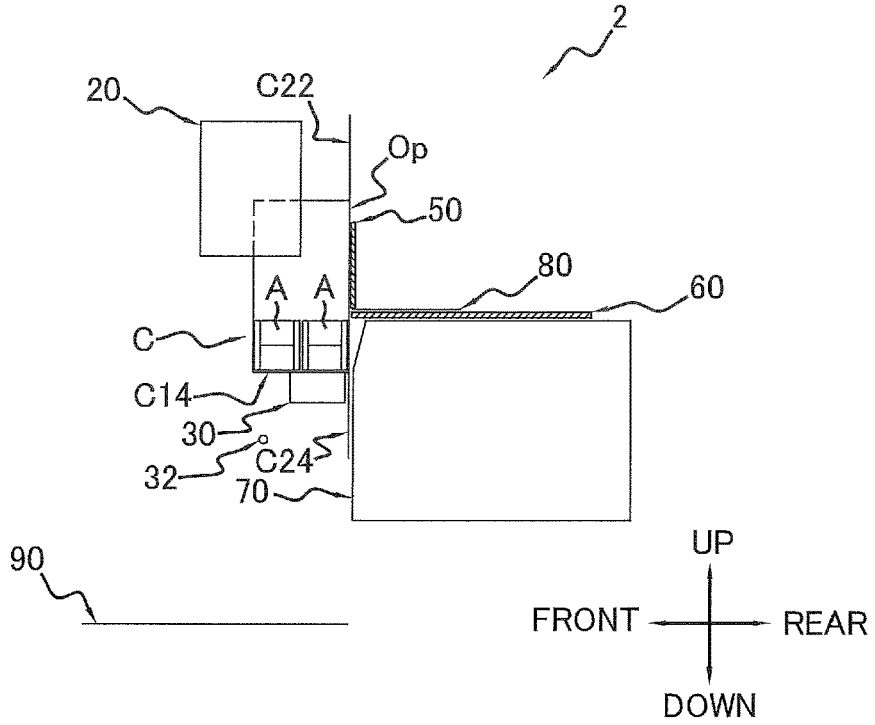
FIG. 5E is a view for describing the operation of the box packing unit 2, and shows a state in which the posture of the cardboard box C in the tilted state has been returned to what it was before.

Next, as shown in FIG. 5E, the cardboard box C rotates a predetermined angle so that the posture of the cardboard box C is returned to what it was before. At this time, the control unit 100 controls the rotation mechanism 40 and the servo motor 41 to rotate the cardboard box C a predetermined angle so that the opening Op of the cardboard box C faces sideways (rearward). As shown in FIG. 5A to FIG. 5G, the cardboard box C rotates clockwise in a case where it is viewed from the right side. The angle of rotation of the cardboard box C is the same as the angle of rotation when the cardboard box C was tilted. For that reason, this rotation operation returns the cardboard box C to a state in which it is not tilted. The cardboard box C before tilting which is shown in FIG. 5B and the cardboard box C that has moved downward which is shown in FIG. 5E differ only in position in the up and down direction. That is, the position of the cardboard box C in the front and rear direction is the same in FIG. 5B and FIG. 5E.

Figure 5F:
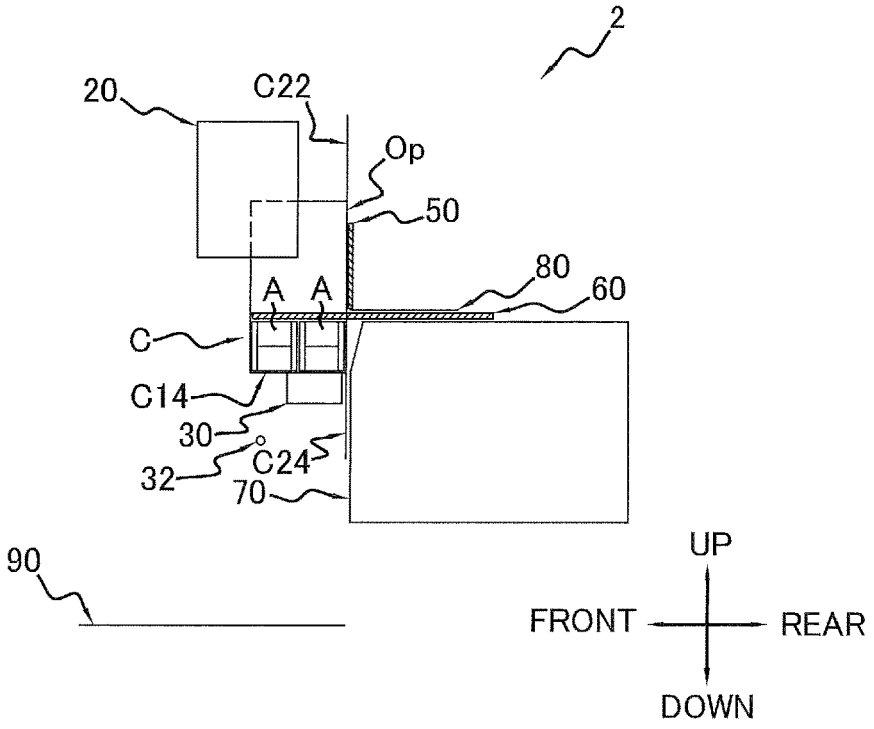
FIG. 5F is a view for describing the operation of the box packing unit 2, and shows a state in which the shutter has been reinserted into the cardboard box C.

Next, as shown in FIG. 5F, the shutter 60 is inserted into the cardboard box C. At this time, the control unit 100 controls the shutter 60 to move the shutter 60 forward and insert the shutter 60 through the opening Op of the cardboard box C. At this time, the height position of the shutter 60 is positioned higher than the first layer of the articles A held in the cardboard box C. That is, there is a space between the first layer of the articles A and the shutter 60 in the cardboard box C.

Figure 5G:
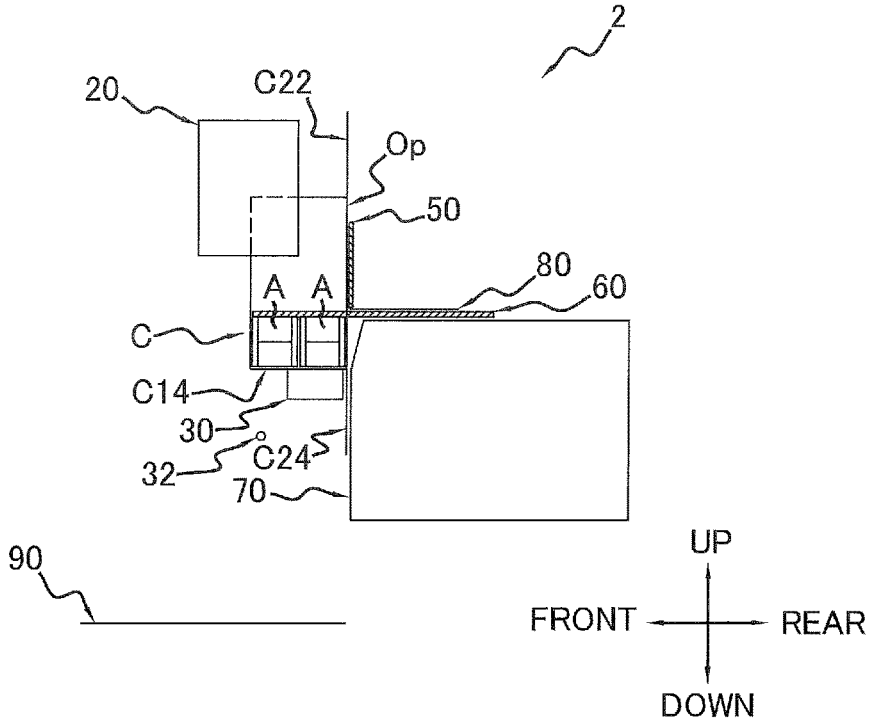
FIG. 5G is a view for describing the operation of the box packing unit 2, and shows a state in which the cardboard box C has been moved slightly upward.

Next, as shown in FIG. 5G, the cardboard box C rises. At this time, the control unit 100 controls the retention mechanism 30 to move the cardboard box C upward along the up and down direction. How much the cardboard box C is moved in the up and down direction is the same as, or substantially the same as, the up and down direction dimension of the space between the first layer of the articles A and the shutter 60 in the cardboard box C. This operation eliminates the space between the first layer of the articles A and the shutter 60 in the cardboard box C. That is, in the cardboard box C, the first layer of the articles A and the shutter 60 come into contact with each other.

Next, the control unit 100 controls the push-in mechanism 50 to move the push-off plate of the push-in mechanism 50 rearward. Additionally, one row's worth of the articles A to be pushed next into the cardboard box C is conveyed by the article conveyance mechanism 80 to the rear of the opening Op of the cardboard box C and the front of the push-off plate of the push-in mechanism 50. This results in the state shown in FIG. 3D.

The above operation described with reference to FIG. 5A to FIG. 5G is a preparatory operation for the retention mechanism 30 to move downward the cardboard box C holding the first layer of two rows of the articles A so that the second layer of two rows of the articles A can be put into the cardboard box C. However, the operation shown in FIG. 5A to FIG. 5G can also be applied to a preparatory operation for the retention mechanism 30 to move downward the cardboard box C holding the second layer of two rows of the articles A so that the third layer of two rows of the articles A can be put into the cardboard box C.

(3) Characteristics (3-1)

The box packing device 10 performs an operation in which, after it has pushed the articles A into the cardboard box C that is in a state in which the opening Op faces sideways, it temporarily moves the cardboard box C away from the guide 70 while moving the cardboard box C downward as shown in FIG. 5B and FIG. 5C. Specifically, the box packing device 10 moves the cardboard box C downward along the up and down direction as shown in FIG. 5D while maintaining the state in which the cardboard box C is away from the guide 70 as shown in FIG. 5C, and thereafter brings the cardboard box C closer to the guide 70 as shown in FIG. 5E.

Figure 6:
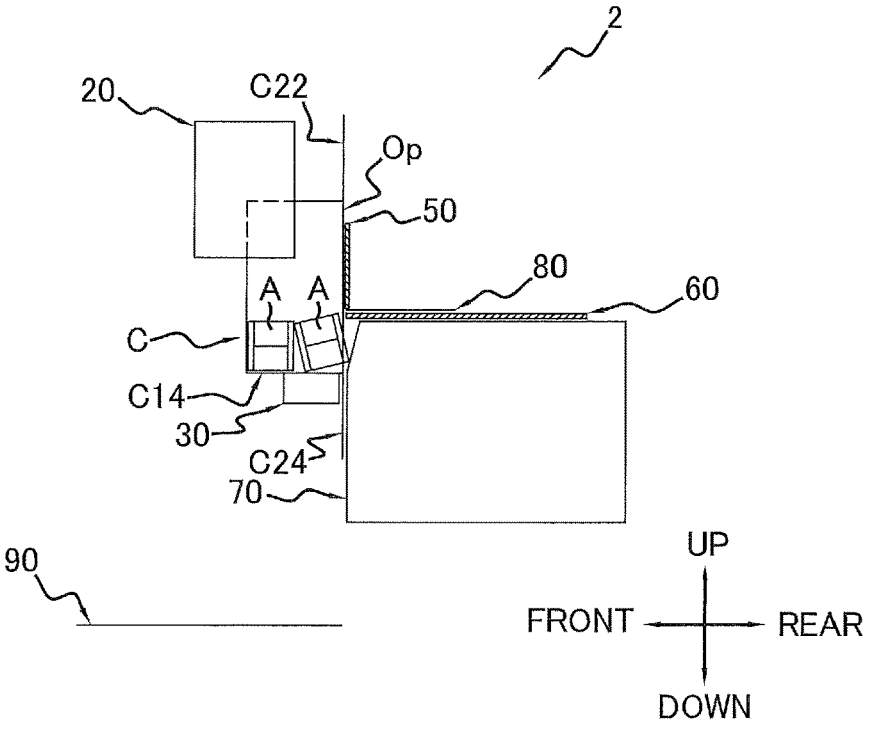
FIG. 6 is a view showing a state in which an article A that has expanded inside the cardboard box C has gotten caught on a guide 70 and is rotating.

The box packing device 10 inhibits, by means of the operation of temporarily moving the cardboard box C away from the guide 70, the articles A from getting caught on the guide 70 or the like and rotating in a case where the articles A have expanded in the cardboard box C while the box packing device 10 is moving the cardboard box C downward. For example, in a case where the sum of the front and rear direction dimensions of two rows of the articles A that have been put into the same layer in the cardboard box C is longer than the front and rear direction dimension of the cardboard box C, the two rows of the articles A just after having been put into the same layer in the cardboard box C by the push-in mechanism 50 become compressed in the front and rear direction. When the cardboard box C is moved downward in that state, the compressed articles A become freed from the push-in mechanism 50 as shown in FIG. 6. Because of this, sometimes the compressed articles A expand in the front and rear direction. FIG. 6 is a view showing a state in which an article A that has expanded inside the cardboard box C has gotten caught on the guide 70 and is rotating. When the state shown in FIG. 6 occurs, there is the concern that the article A will become sandwiched between the cardboard box C and the shutter 60 or the like and become compressed. In a case where the articles A are bags in which a food such as potato chips is packaged by a packaging material, there is the concern that if the articles A become compressed the food inside the packaging material will sustain damage.

The box packing device 10 ensures, by means of the operation of temporarily moving the cardboard box C away from the guide 70, that the articles A do not contact the guide 70 even if the articles A expand in the cardboard box C. Consequently, the box packing device 10 inhibits the occurrence of a problem where, when packing the articles A into the cardboard boxes C, the articles A end up rotating inside the cardboard boxes C, so reliability can be improved. Furthermore, because of this, the box packing device 10 can inhibit the occurrence of a state in which the articles A are not properly packed into the cardboard boxes C.

(3-2)

The box packing device 10 temporarily tilts the cardboard box C so that the opening Op of the cardboard box C faces upward to perform the operation of temporarily moving the cardboard box C away from the guide 70 while moving the cardboard box C downward. Specifically, the box packing device 10 can temporarily move the cardboard box C away from the guide 70 by tilting the cardboard box C using the rotation mechanism 40. The rotation mechanism 40 is also used to place the cardboard box C packed with the articles A onto the conveyor belt of the box conveyance mechanism 90 as shown in FIG. 3H. Consequently, the box packing device 10 can easily execute the operation of temporarily moving the cardboard box C away from the guide 70 simply by tilting the cardboard box C using the rotation mechanism 40 for placing the cardboard box C onto the conveyor belt of the box conveyance mechanism 90. Furthermore, the box packing device 10 can easily control the distance between the cardboard box C and the guide 70 at appropriate timings by using the servo motor 41 of the rotation mechanism 40 to finely set and control the angle of rotation of the cardboard box C.

(3-3)

The box packing device 10 returns the distance between the cardboard box C and the guide 70 to what it was before and reinserts the shutter 60 inside the cardboard box C as shown in FIG. 5F, and thereafter raises the cardboard box C to a position in which the articles A that have been pushed into the cardboard box C come into contact with the shutter 60 as shown in FIG. 5G. In the state shown in FIG. 5F, a space is formed between the articles A that have been pushed into the cardboard box C and the shutter 60. By raising the cardboard box C the dimension of the space in this state, the articles A that have been pushed into the cardboard box C come into contact with the shutter 60 as shown in FIG. 5G. Because of this, when the box packing device 10 puts the third layer of the articles A into the cardboard box C as shown in FIG. 3F, the occurrence of a situation where the articles A hit the side surface C12 on the upper side of the cardboard box C such that the articles A are not smoothly put into the cardboard box C is inhibited. Consequently, the box packing device 10 can, by means of the above operation, efficiently pack the articles A into the cardboard boxes C.

(3-4)

The box packing device 10 includes the guide 70 for preventing the articles A that have already been put into the cardboard box C from spilling and falling out. As shown in FIG. 3A to FIG. 3H, the guide 70 has the sloping portion on the upper end portion of the front surface. The sloping portion has a shape that recedes upward away from the cardboard boxes C. The sloping portion of the guide 70 inhibits to some extent the articles A from getting caught on the guide 70 and rotating in a case where the articles A have expanded in the cardboard box C. When the guide 70 does not have the sloping portion, there is the concern that the corner portion of an article A that has expanded will get caught in the space between the push-off plate of the push-in mechanism 50 and the guide 70, for example, when the cardboard box C moves downward. When the guide 70 does have the sloping portion, the occurrence of such catching of the articles A is inhibited when the cardboard box C moves downward.

(4) Example Modification

An embodiment of the invention has been described above, but the invention is not limited to the embodiment and various changes can be made thereto in a range that does not depart from the spirit of the invention.

An example modification of the box packing device 10 will be described. The box packing device 10 of the embodiment rotates the cardboard box C a predetermined angle to a tilted state as shown in FIG. 5C, thereafter moves the cardboard box C downward along the up and down direction as shown in FIG. 5D, and thereafter rotates the cardboard box C again a predetermined angle to return the posture of the cardboard box C to what it was before as shown in FIG. 5E. However, the box packing device 10 can also perform another operation with respect to the cardboard box C in addition to the operation of temporarily tilting the cardboard box C when moving the cardboard box C downward.

For example, after rotating the cardboard box C a predetermined angle to a tilted state, the box packing device 10 can perform an operation in which it moves the cardboard box C a predetermined distance forward to move it away from the guide 70. In this case, the box packing device 10 next moves the cardboard box C downward along the up and down direction, thereafter moves the cardboard box C a predetermined distance rearward to bring it closer to the guide 70, and thereafter rotates the cardboard box C a predetermined angle again to return the posture of the cardboard box C to what it was before. That is, the box packing device 10 further performs, in addition to the operation of rotating the cardboard box C to temporarily move the cardboard box C away from the guide 70, an operation in which it moves the cardboard box C in the front and rear direction to temporarily move the cardboard box C away from the guide 70. By means of these operations, the box packing device 10 can sufficiently move the cardboard box C away from the guide 70 when moving the cardboard box C downward.

In this example modification, the box packing device 10 can also rotate the cardboard box C a predetermined angle to a tilted state after performing the operation of moving the cardboard box C a predetermined distance forward to move it away from the guide 70. In this case, the box packing device 10 next moves the cardboard box C downward along the up and down direction, thereafter rotates the cardboard box C a predetermined angle again to return the posture of the cardboard box C to what it was before, and thereafter moves the cardboard box C a predetermined distance rearward to bring it closer to the guide 70.

REFERENCE SIGNS LIST

10 Box Packing Device
30 Retention Mechanism
40 Rotation Mechanism
41 Servo Motor
50 Push-in Mechanism
60 Shutter
70 Guide
100 Control Unit
Op Opening
C Cardboard Box (Box)
A Article

The invention claimed is:

1. A box packing device comprising:

a push-in mechanism configured to push, into a box in a state in which an opening thereof faces sideways, an article through the opening;

a retention mechanism configured to retain the box in the state in which the opening faces sideways and lower the box after the article have been pushed into the box by the push-in mechanism;

a guide that opposes the opening and is configured to prevent the article from falling out from the opening of the box that has been lowered by the retention mechanism; and a control unit configured to temporarily increase a distance between the box and the guide from an initial distance to a temporarily increased distance after the article have been pushed into the box by the push-in mechanism, control the retention mechanism to lower the box, and thereafter return the temporarily increased distance to the initial distance.

2. The box packing device according to claim 1, wherein the control unit is further configured to temporarily tilt the box so that the opening faces upward.

3. The box packing device according to claim 1, further comprising a shutter that is temporarily inserted inside the box while the push-in mechanism is pushing the article into the box, wherein the push-in mechanism is further configured to push the article resting on top of the shutter into the box.

4. The box packing device according to claim 3, wherein the control unit is further configured to remove the shutter from the box before temporarily increasing the distance, and insert the shutter inside the box after returning the temporarily increased distance to the initial distance.

5. The box packing device according to claim 4, wherein the control unit is further configured to, after inserting the shutter inside the box after having returned the temporarily increased distance to the initial distance, raise the box to a position in which the article that have been pushed into the box comes into contact with the shutter.

6. The box packing device according to claim 1, further comprising a rotation mechanism configured to rotate the box to switch the box between a state in which the opening faces sideways and a state in which the opening faces upward, wherein the control unit is further configured to control the rotation mechanism to temporarily increase the distance.

7. The box packing device according to claim 6, wherein the rotation mechanism has a servo motor configured to control a rotational speed of the box.

8. The box packing device according to claim 1, wherein the guide has a shape that recedes upward away from the box.

* * * * *